US007347709B2

(12) United States Patent
Burkhard et al.

(10) Patent No.: US 7,347,709 B2
(45) Date of Patent: Mar. 25, 2008

(54) CONNECTOR ASSEMBLY HAVING A SECURING MEMBER

(75) Inventors: Harley D. Burkhard, Saginaw, MI (US); Kenneth G. Johnston, Freeland, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/704,670

(22) Filed: Feb. 9, 2007

(65) Prior Publication Data

US 2007/0184720 A1 Aug. 9, 2007

Related U.S. Application Data

(60) Provisional application No. 60/771,933, filed on Feb. 9, 2006.

(51) Int. Cl.
*H01R 13/627* (2006.01)

(52) U.S. Cl. ..... 439/352; 439/595; 439/752

(58) Field of Classification Search ..... 439/352, 439/595, 752

See application file for complete search history.

(56) References Cited

U.S. PATENT DOCUMENTS 6,811,437 B2 * 11/2004 Nimura ..... 439/595
7,014,511 B2 * 3/2006 Sagawa et al. ..... 439/752

* cited by examiner

*Primary Examiner*—Truc Nguyen
(74) *Attorney, Agent, or Firm*—Michael D. Smith

(57) ABSTRACT

A connector assembly for connecting an electrical terminal to a terminal receiver includes a body portion having a first surface including a biasable lock member extending therefrom and a second surface defining a plurality of recesses. The connector assembly also includes a securing member having a plurality of finger portions with one of the finger portions disposed in each of the recesses so as to prevent or lessen any movement of the electrical terminal relative to the terminal receiver within the recess. The securing member has a locking tab member that can engage and pivot the lock member for locking the securing member to the body portion.

19 Claims, 12 Drawing Sheets

CONNECTOR ASSEMBLY HAVING A SECURING MEMBER

CROSS-REFERENCE TO RELATED APPLICATION

The instant application claims priority to U.S. Provisional Patent Application Ser. No. 60/771,933, which was filed on Feb. 9, 2006.

FIELD OF THE INVENTION

The present invention relates generally to connector assemblies for secure connection of electrical terminals.

BACKGROUND OF THE INVENTION

Conventional connector assemblies used to connect electrical terminals typically include a main body which is adapted to mount about a clip having a series of electrical terminals. Each of the electrical terminals is designed to receive an opposing electrical terminal to create an electrical connection. As known to those skilled in the art, movement of connected electrical terminals can result in fretting corrosion at the interface of the electrical terminals. In particular, the movement of the connected electrical terminals allows for oxidation to occur at the electrical interface. The oxidation creates an oxide layer, which has a high resistance and can cause an undesirable open circuit.

Accordingly, there exists a need for new and improved connector assemblies for securely connecting electrical terminals, including connector assemblies operable to reduce, if not eliminate, any movement between the connected electrical terminals thereby eliminating any fretting corrosion.

SUMMARY OF THE INVENTION

A connector assembly for connection to an electrical terminal is provided. The connector assembly comprises a body portion having a first surface including a biasable lock member extending therefrom and a second surface defining at least one recess. A terminal receiver is at least partially disposed in the recess. A securing member has a first securing portion selectively disposed in the recess and operable to engage at least a portion of the terminal receiver for minimizing movement between the electrical terminal and the terminal receiver. The securing member also has a second securing portion that is operable to engage the biasable lock member for locking the securing member to the body portion.

Accordingly, the connector assembly of the subject invention includes a securing member that operates to reduce, if not eliminate, any movement between the electrical terminal and the terminal receiver to eliminate any fretting corrosion.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Advantages of the present invention will be readily appreciated as the same becomes better understood by reference to the following detailed description when considered in connection with the accompanying drawings wherein.

The same reference numerals refer to the same parts throughout the various Figures.

DETAILED DESCRIPTION OF THE PREFERRED EMBODIMENT

Figure 1:
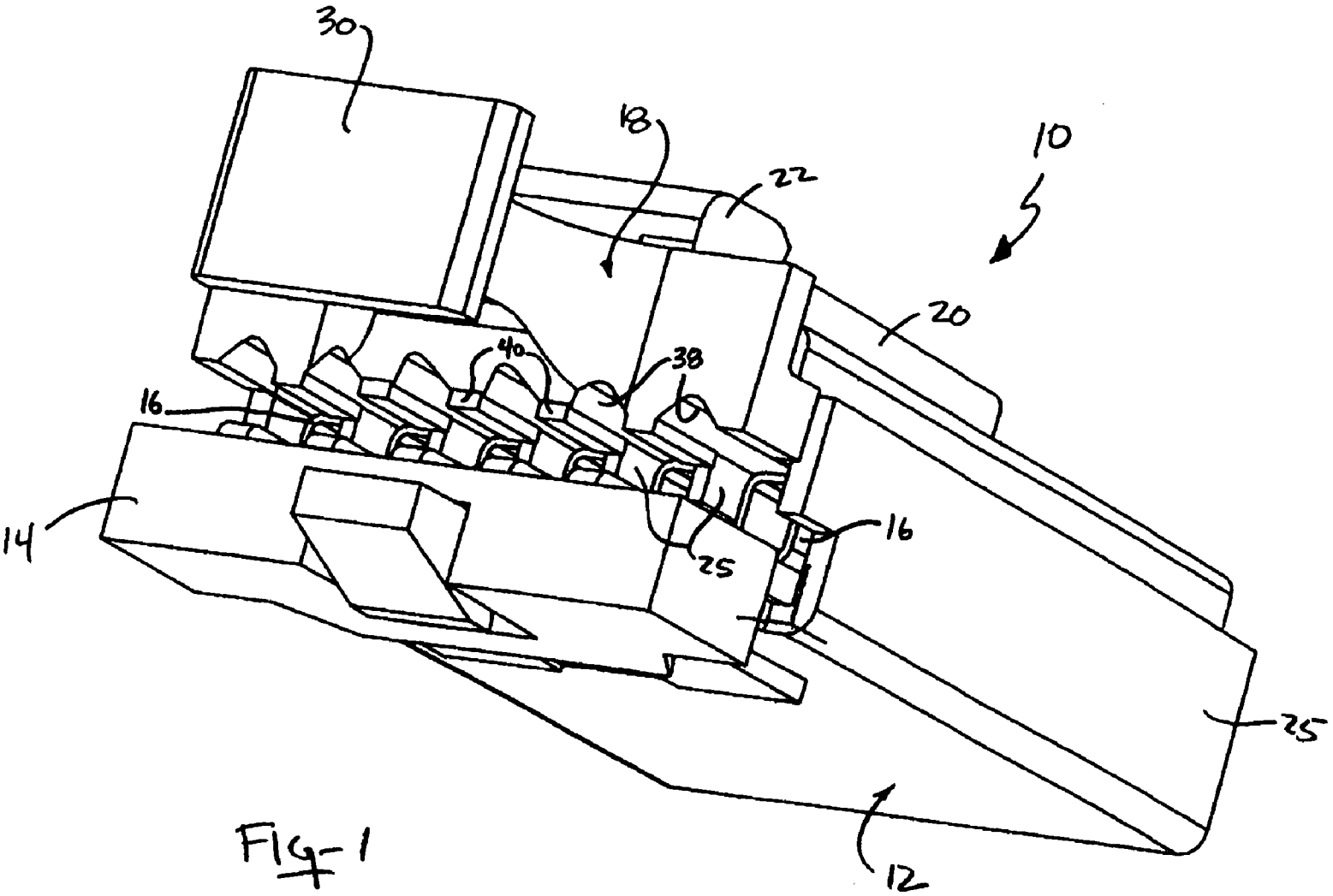
FIG. 1 is a front perspective view of a connector assembly having a body portion and a securing member in accordance with the present invention.
Figure 2:
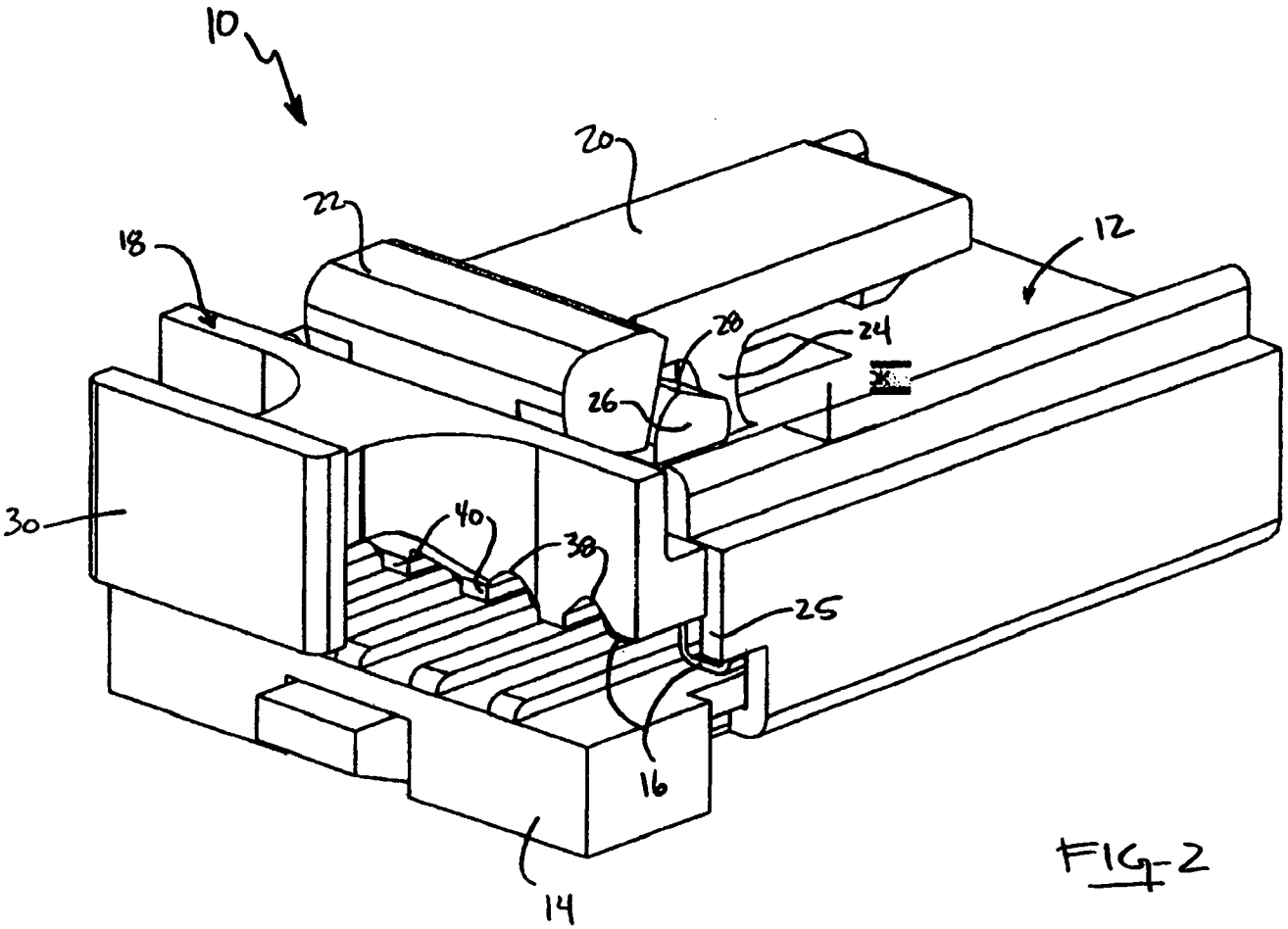
FIG. 2 is another front perspective view of the connector assembly.
Figure 3:
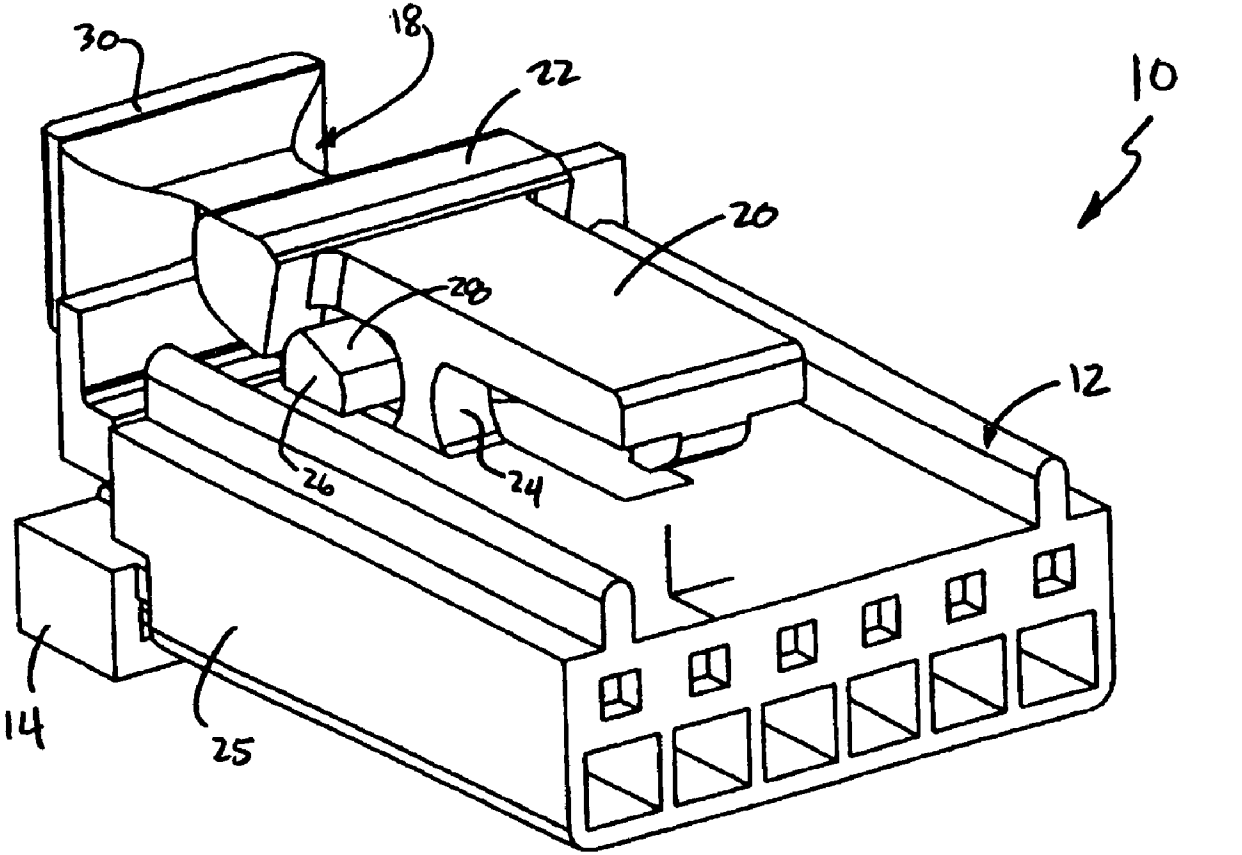
FIG. 3 is a rear perspective view of the connector assembly.
Figure 4:
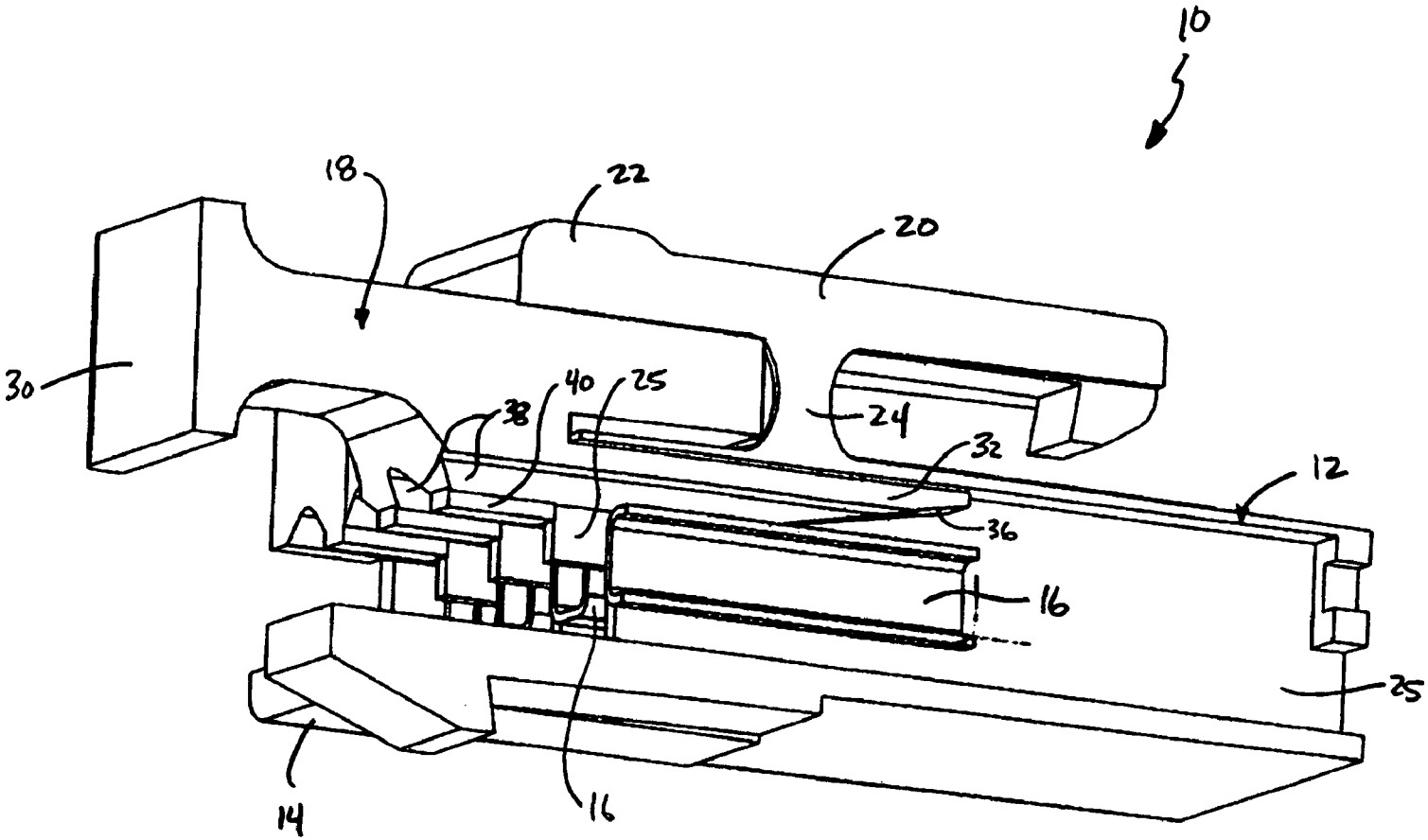
FIG. 4 is a cross-sectional perspective view of the connector assembly.
Figure 5:
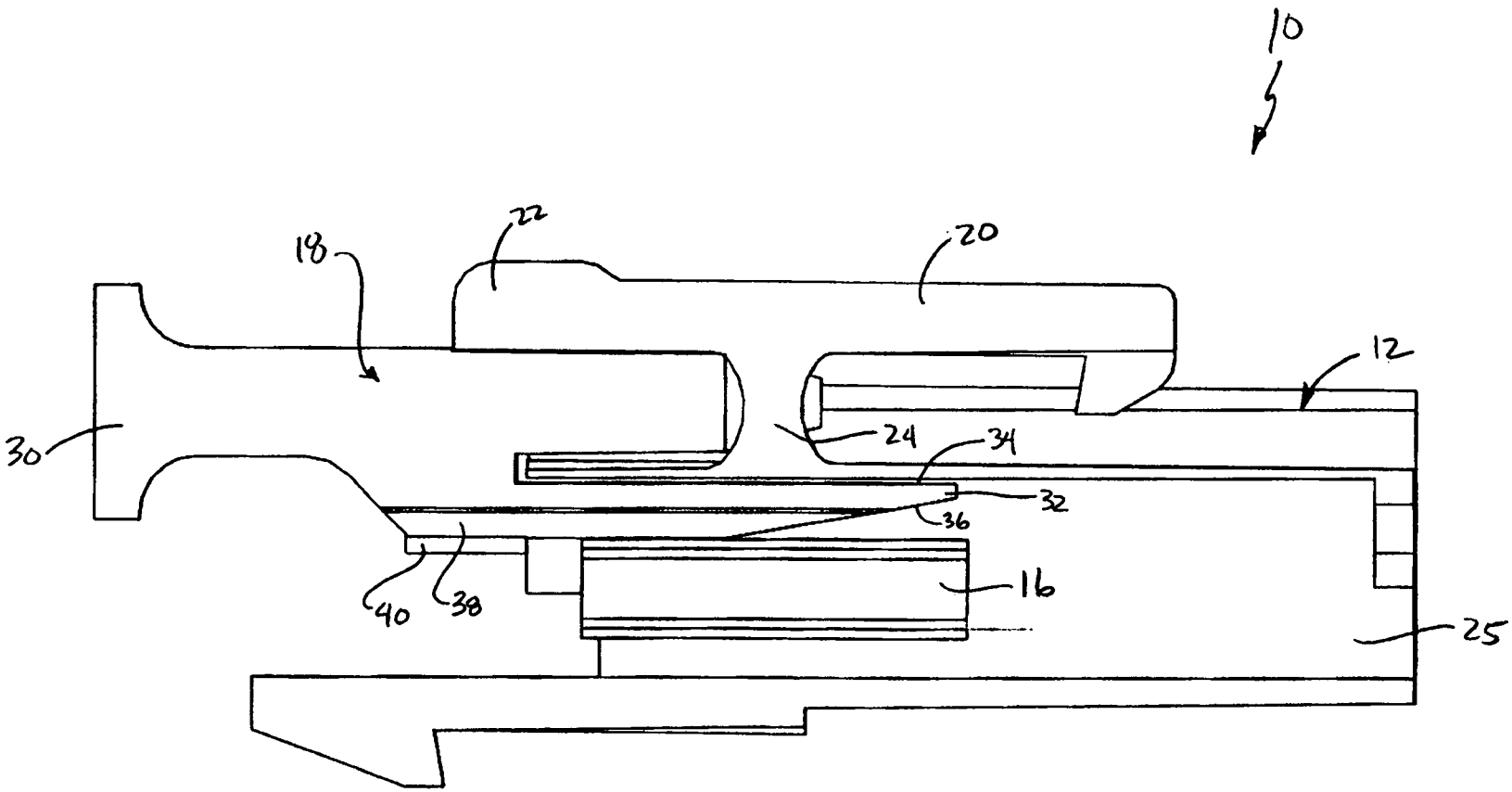
FIG. 5 is a cross-sectional side view of the connector assembly.
Figure 6:
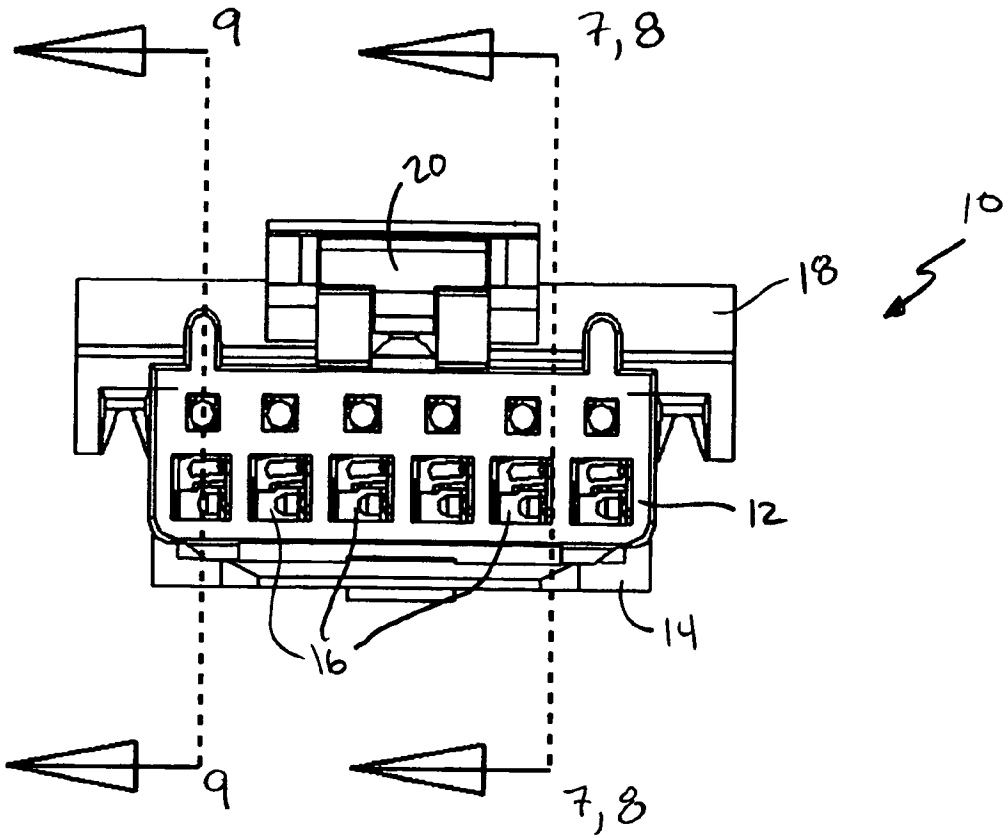
FIG. 6 is an end view of the connector assembly having an electrical terminal connected thereto.

The following description of the preferred embodiment(s) is merely exemplary in nature and is in no way intended to limit the invention, its application, or uses.

Referring to the Figures generally, and specifically to FIGS. 1-5, a connector assembly is shown generally at 10. The connector assembly 10 primarily includes a body portion 12 having a first surface including a biasable lock member 20 extending therefrom. The body portion 12 also includes a second surface defining at least one, and preferably a plurality, of recesses or chambers. A terminal receiver 16 is at least partially disposed in each of the recesses or chambers to define a plurality or series of terminal receivers 16. The terminal receivers 16 are shown schematially in FIGS. 1-5. A clip 14 is mounted about the body portion 12 and is discussed in greater detail below.

The terminal receivers 16 are shown in greater detail in FIGS. 6-9. Each of the terminal receivers 16 is designed to receive an electrical terminal 17 to enable an electrical connection therebetween. It should be appreciated that either of the electrical terminals 17 or the terminal receivers 16 can be configured as pins, receptacles, slots, and/or the like. One preferred embodiment of the electrical terminals 17 and terminal receivers 16 is shown in FIGS. 6-9 and is discussed in greater detail below.

As previously noted, movement of the connected electrical terminals can result in fretting corrosion at the interface of the electrical terminals 17 and terminal receivers 16. Therefore, the present connector assembly 10 includes a securing member 18 to reduce, if not eliminate, any movement between the connected electrical terminals 17 and terminal receivers 16 thereby eliminating any fretting corrosion. By way of a non-limiting example, during assembly, the electrical terminals 17 would first be connected to the terminal receivers 16 and then the securing member 18 would be inserted into position as is discussed in greater detail below.

The biasable lock member 20 can be in the form of, but not limited to, a locking finger 20, for retaining the securing member 18 to the body portion 12. The locking finger 20 preferably includes a locking head 22 and is pivotable about a fulcrum 24 to allow insertion of the securing member 18, as well as subsequent removal of the securing member 18. The fulcrum 24 interconnects the body portion 12 and the biasable lock member 20. The body portion 12 also can include a plurality of walls 25 defining the plurality of recesses or chambers. As shown, the walls 25 are parallel to each other to define a services of rectangular shaped recesses or chambers.

Figure 10:
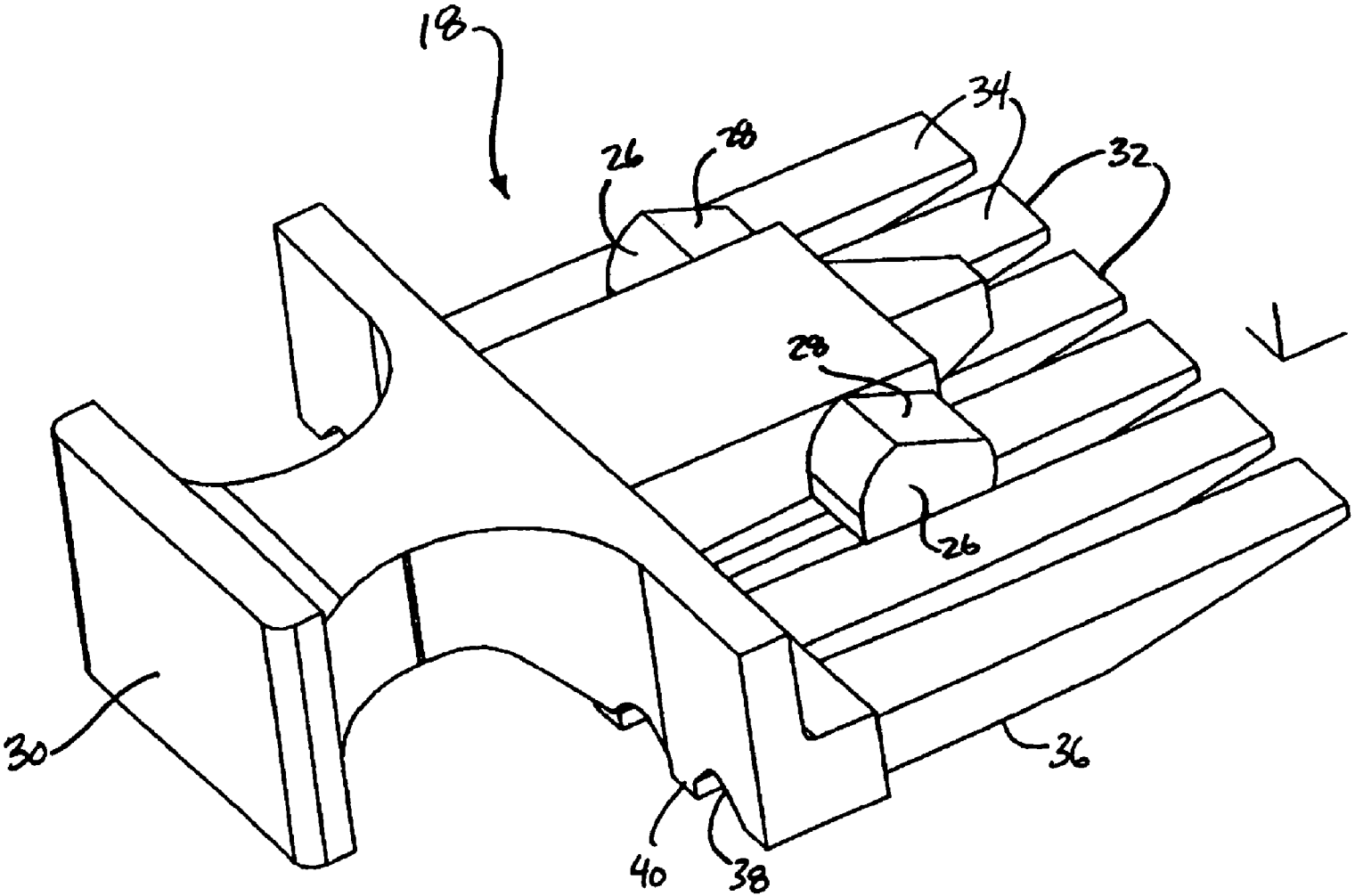
FIG. 10 is a top perspective view of the securing member.
Figure 11:
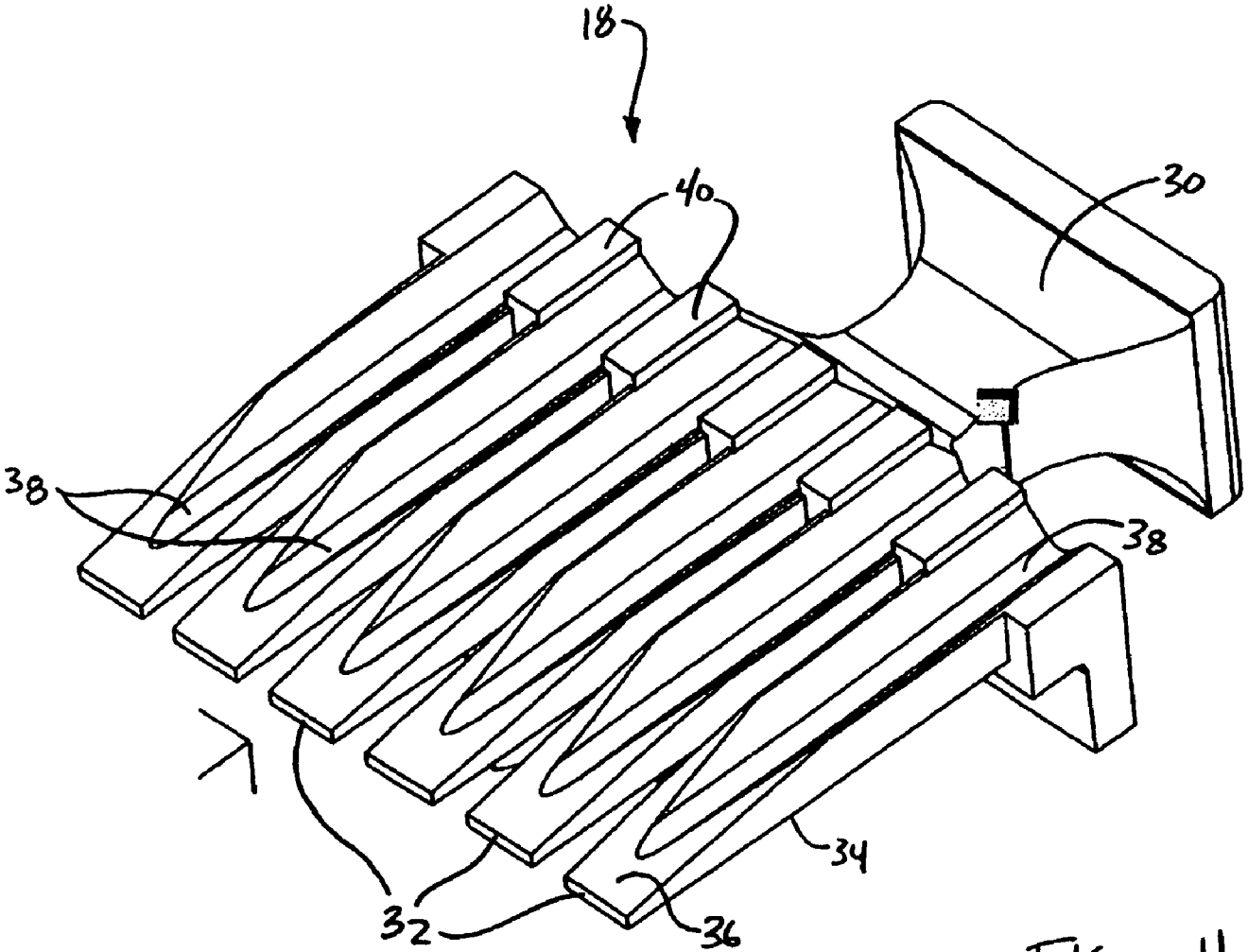
FIG. 11 is a bottom perspective view of the securing member.
Figure 12:
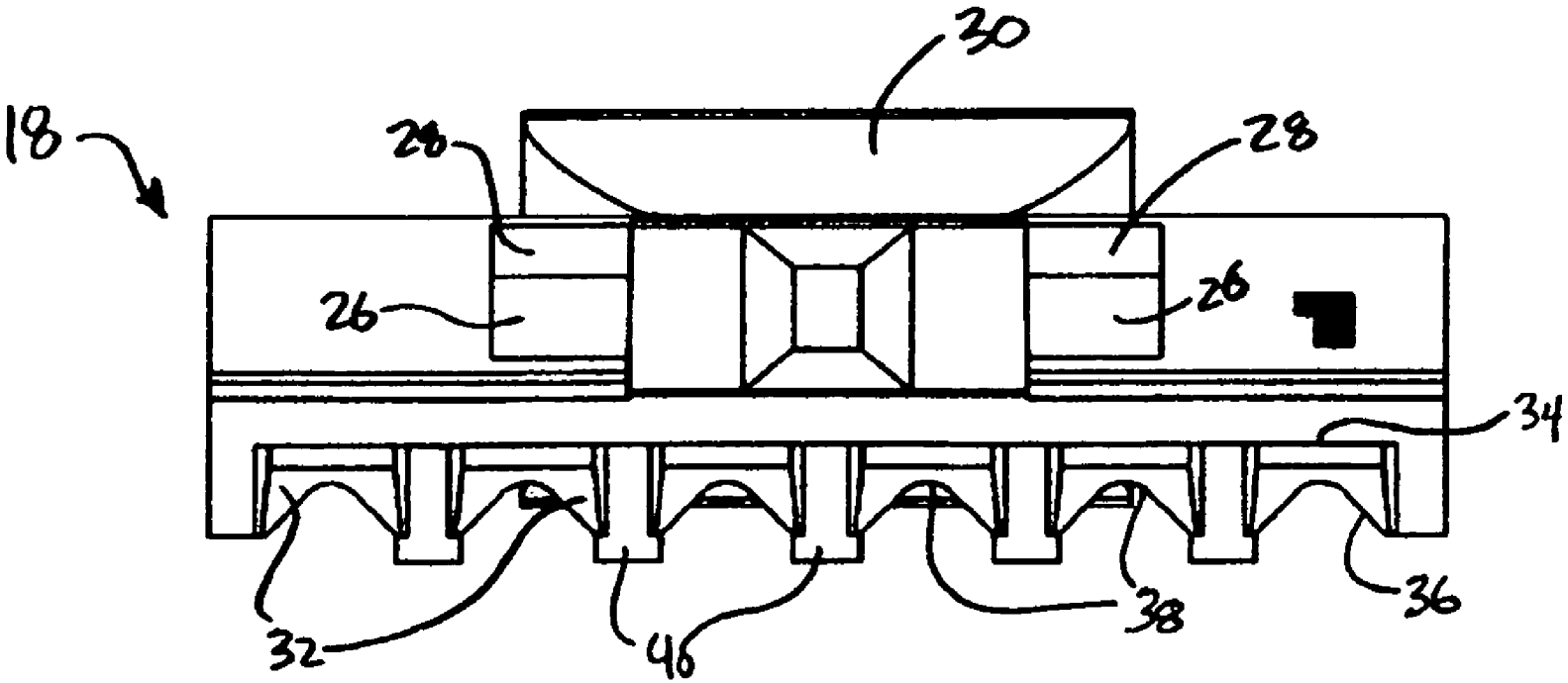
FIG. 12 is an end view of the securing member.

As shown in FIGS. 10-12, the securing member 18 has a first securing portion 32 selectively disposed in the recess and operable to engage at least a portion of the terminal receiver 16 for minimizing movement between the electrical terminal 17 and the terminal receiver 16. The securing member 18 also has a second securing portion 26 operable to engage the biasable lock member 20 for locking the securing member 18 to the body portion 12.

The second securing portion 26 preferably includes at least one and more preferably a pair of locking tab members 26 that engage the locking head 22 during insertion. In particular, the locking tab members 26 each can include a ramped surface portion 28 for engagement with the locking head 22 to force the locking head 22 to pivot upwardly during insertion of the securing member 18 into the recess. Once the locking head 22 clears the locking tab members 26, the locking head 22 can return to an unbiased position behind the locking tab members 26, which prevents removal of the securing member 18. As mentioned above, the locking finger 20 can be pivoted such that the locking head 22 is moved out of engagement with the locking tab members 26 to allow removal of the securing member 18. The securing member 18 also can include a handle portion 30 to provide convenient handling of the securing member 18.

As best shown in FIGS. 1-2, 4-5, 7-9 and 11-12, the first securing portion 32 of the securing member 18 preferably includes at least one and more preferably a plurality of finger portions 32 with one of the finger portions 32 selectively disposed in each of the recesses and operable to engage at least a portion of the terminal receiver 16 associated with each recess for minimizing movement between the electrical terminal 17 and the terminal receiver 16. The finger portions 32 can include a wedge-shaped surface and an area defining a notch 38 on a surface spaced and opposed from the wedge-shaped surface. In particular, the finger portions 32 have a top surface 34 which is substantially flat, and a bottom surface 36 which is tapered to any desired angle. The finger portions 32 of the securing member 18 extend into the recesses or chambers of the body portion 12 when the securing member 18 is inserted into the body portion 12. An appropriately sized notch 38 is formed in each bottom surface 36 of the finger portions 32. The notch 38 is configured to at least partially envelope or encapsulate the connected electrical terminals 17 and terminal receivers 16 to reduce, if not eliminate, any relative axial or lateral movement between the electrical terminals 17 and terminal receivers 16. As shown, the notches 38 preferably each have an inverted V-shaped configuration. Each of the finger portions 32 can be of a common size and configuration. It should be appreciated that the finger portions 32 and the notches 38 could be of any design or configuration to accommodate any type and size of electrical terminals 17 and terminal receivers 16. The securing member 18 also can include a series of stops 40 that engage the wall 25 when the securing member 18 is fully inserted into the body portion 12.

The clip 14 is selectively disposed in each of the recesses and operable to engage at least a portion of the terminal receiver 16 associated with each recess for further minimizing movement between the electrical terminal 17 and the terminal receiver 16. The clip has a substantially U-shaped configuration with one side of the U being longer than the other. The clip 14 is held into position on the body portion 12 by a locking tab.

Figure 7:
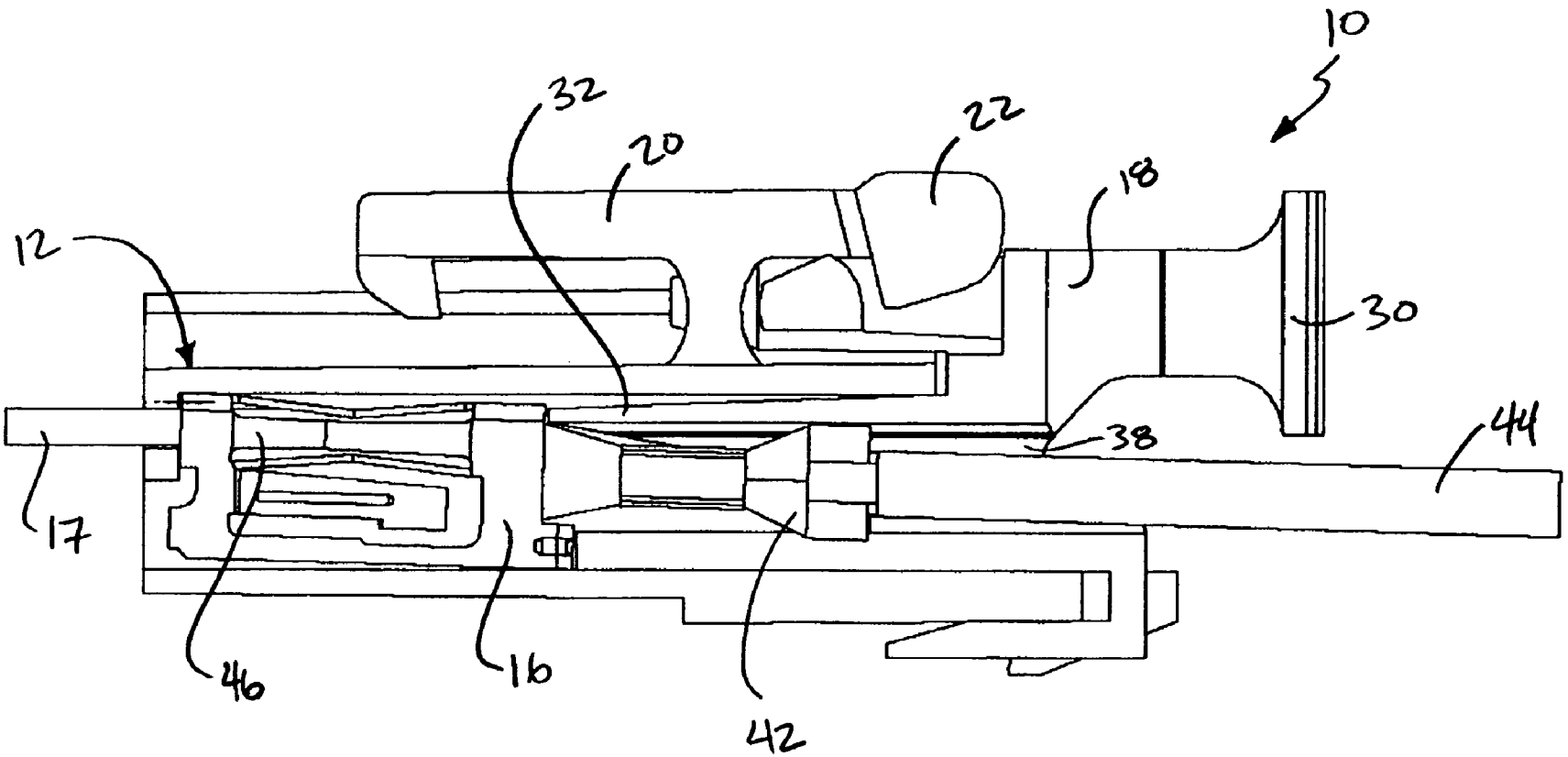
FIG. 7 is a cross-sectional side view of the connector assembly taken along line 7-7 of FIG. 6.
Figure 8:
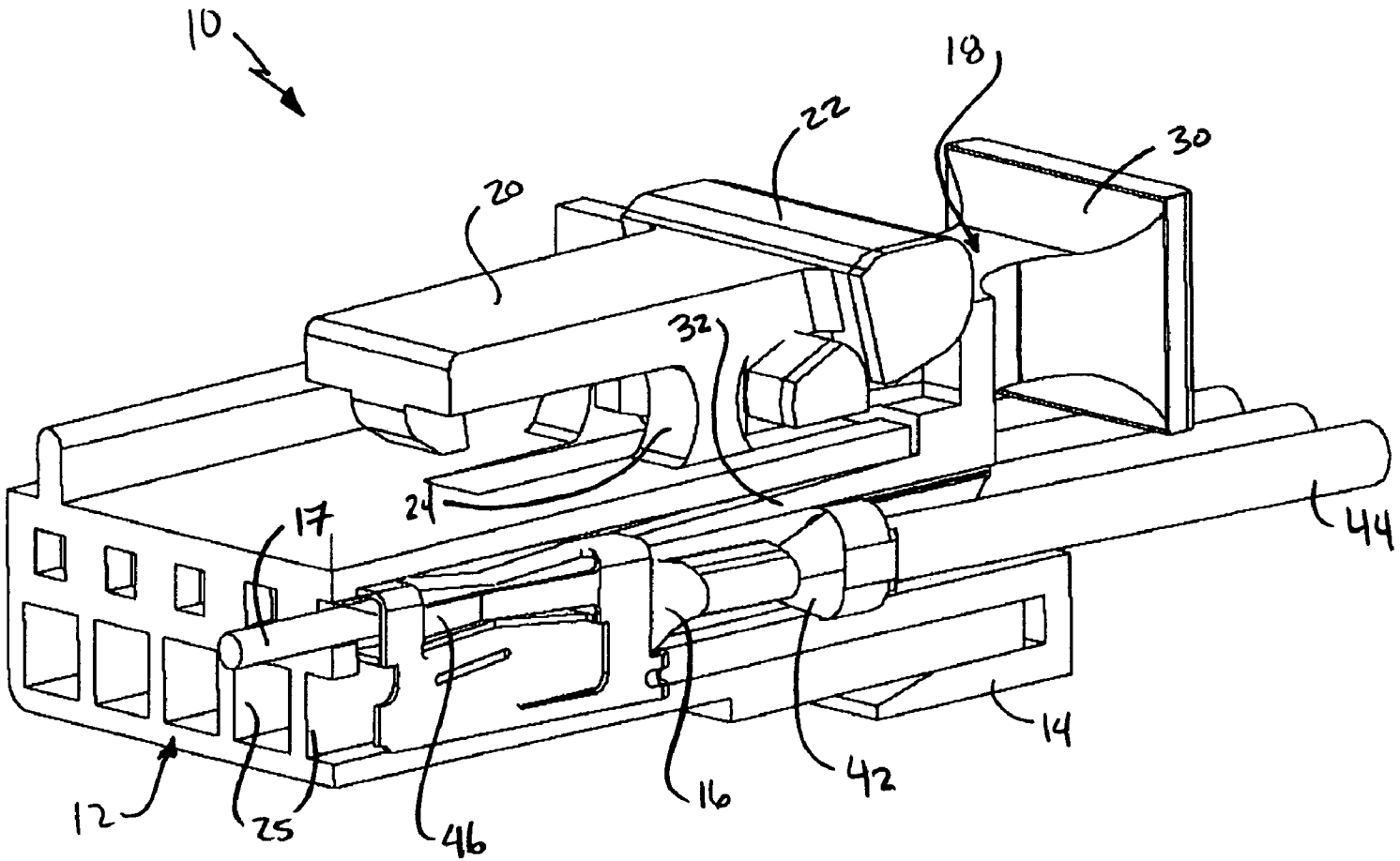
FIG. 8 is a cross-sectional perspective view of the connector assembly taken along line 8-8 of FIG. 6.
Figure 9:
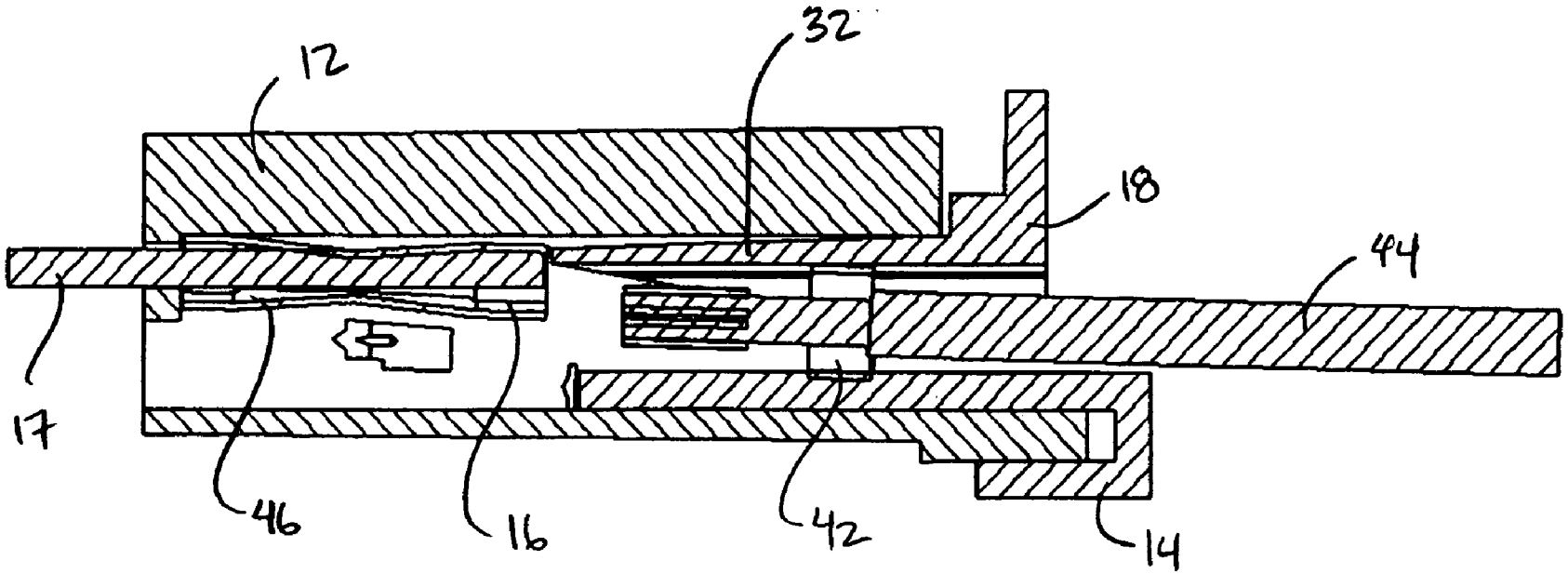
FIG. 9 is a cross-sectional side view of the connector assembly taken along line 9-9 of FIG. 6.

The terminal receivers 16 each includes a top and a bottom with the notches 38 of the finger portions 32 engaging the top and the clip 14 engaging the bottom to sandwich the terminal receivers 16 between the securing member 18 and the clip 14. As shown in FIGS. 7-9, the embodiment shown of the terminal receiver 16 includes a first receptor portion 42 for receiving an electrical wire 44 and a second receptor portion 46 for receiving the electrical terminal 17. In the embodiment shown, the electrical terminal 17 is configured as a pin 17. Hence, as shown, the terminal receiver 16 is configured as a female portion and the electrical terminal is configured as a male portion. As noted above, the female and male portions may be reversed and may be of any suitable design.

The invention has been described in an illustrative manner, and it is to be understood that the terminology which has been used is intended to be in the nature of words of description rather than of limitation. It is now apparent to those skilled in the art that many modifications and variations of the present invention are possible in light of the above teachings. It is, therefore, to be understood that the invention may be practiced otherwise than as specifically described.

What is claimed is:

1. A connector assembly for connection to an electrical terminal, said assembly comprising:

a body portion having a first surface including a biasable lock member extending therefrom and a second surface defining at least one recess with said first surface and said biasable lock member being external to said recess;

a terminal receiver at least partially disposed in the recess; and a securing member having a first securing portion selectively disposed in the recess and operable to engage at least a portion of the terminal receiver for minimizing movement between the electrical terminal and the terminal receiver and a second securing portion operable to engage the biasable lock member external to said recess for locking the securing member to the body portion.

2. An assembly as set forth in claim 1 wherein the biasable lock member is pivotable about a fulcrum interconnecting the body portion and the biasable lock member.

3. An assembly as set forth in claim 1 wherein the first securing portion includes a finger portion selectively disposed in the recess and operable to engage at least a portion of the terminal receiver for minimizing movement between the electrical terminal and the terminal receiver.

4. An assembly as set forth in claim 1 wherein the terminal receiver includes a first receptor for receiving an electrical wire and a second receptor for receiving the electrical terminal.

5. An assembly as set forth in claim 1 wherein the second securing portion includes a locking tab member operable to engage the biasable lock member and pivot the biasable lock member in a substantially upward direction during insertion of the securing member into the recess.

6. An assembly as set forth in claim 1 wherein the first securing portion includes a wedge-shaped surface and an area defining a notch on a surface spaced and opposed from the wedge-shaped surface.

7. An assembly as set forth in claim 1 wherein the biasable lock member includes a substantially planar body portion and a locking head member formed on a distal end of the substantially planar body portion with the locking head member including a width greater than that of the substantially planar body portion.

8. An assembly as set forth in claim 1 wherein the securing member includes a handle portion formed thereon.

9. An assembly as set forth in claim 3 wherein the finger portion includes a wedge-shaped surface and an area defining a notch on a surface spaced and opposed from the wedge-shaped surface.

10. An assembly as set forth in claim 4 wherein the second surface of the body portion defines a plurality of recesses with a terminal receiver disposed in each of the recesses to define a plurality of terminal receivers.

11. An assembly as set forth in claim 10 wherein the first securing portion includes a plurality of finger portions with one of the finger portions selectively disposed in each of the recesses to engage at least a portion of the terminal receiver associated with each recess.

12. An assembly as set forth in claim 11 wherein each of the finger portions include a wedge-shaped surface and an area defining a notch on a surface spaced and opposed from the wedge-shaped surface.

13. An assembly as set forth in claim 11 further including a clip selectively disposed in each of the recesses to engage at least a portion of the terminal receiver associated with each recess.

14. An assembly as set forth in claim 13 wherein each of the terminal receivers include a top surface and a bottom surface with the finger portions engaging the top surfaces and the clip engaging the bottom surfaces to sandwich the terminal receivers between the securing member and the clip.

15. An assembly as set forth in claim 5 wherein the locking tab member includes a ramped surface portion operable to engage the biasable lock member and pivot the biasable lock member in a substantially upward direction during insertion.

16. An assembly as set forth in claim 6 wherein the notch is substantially V-shaped for at least partially enveloping the electric terminal and terminal receiver.

17. A connector assembly for connection to an electrical terminal, said assembly comprising:

a body portion having a first surface including a biasable lock member extending therefrom and a second surface defining at least one recess;

a terminal receiver at least partially disposed in the recess;

a securing member having a finger portion selectively disposed in the recess and operable to engage at least a portion of the terminal receiver for minimizing movement between the electrical terminal and the terminal receiver and a second securing portion operable to engage the biasable lock member for locking the securing member to the body portion; and a clip selectively disposed in the recess and operable to engage at least a portion of the terminal receiver for further minimizing movement between the electrical terminal and the terminal receiver.

18. An assembly as set forth in claim 17 wherein the terminal receiver includes a top surface and a bottom surface with the finger portion engaging the top surface and the clip engaging the bottom surface to sandwich the terminal receiver between the securing member and the clip.

19. An assembly as set forth in claim 17 wherein the finger portion includes a wedge-shaped surface and an area defining a notch on a surface spaced and opposed from the wedge-shaped surface.

* * * * *